US006983810B2

(12) United States Patent
Hara et al.

(10) Patent No.: US 6,983,810 B2
(45) Date of Patent: Jan. 10, 2006

(54) ELECTRIC POWER TOOL WITH IMPROVED SPEED CHANGE GEARING

(75) Inventors: Akihito Hara, Amagun (JP); Hideki Abe, Anjo (JP)

(73) Assignee: Makita Corporation, Anjo (JP)

( * ) Notice: Subject to any disclaimer, the term of this patent is extended or adjusted under 35 U.S.C. 154(b) by 30 days.

(21) Appl. No.: 10/774,186

(22) Filed: Feb. 6, 2004

(65) Prior Publication Data

US 2004/0157698 A1 Aug. 12, 2004

(30) Foreign Application Priority Data

Feb. 7, 2003 (JP) ..... 2003-31542

(51) Int. Cl.
*B25F 5/00* (2006.01)

(52) U.S. Cl. ..... 173/176; 173/48; 173/216

(58) Field of Classification Search ..... 173/47, 173/48, 176, 216, 217, 2, 104, 109; 475/265, 475/290, 299, 320, 286, 263
See application file for complete search history.

(56) References Cited

U.S. PATENT DOCUMENTS 4,791,833 A * 12/1988 Sakai et al. ..... 475/299
5,339,908 A 8/1994 Yokota et al.
5,550,416 A * 8/1996 Fanchang et al. ..... 310/83
6,142,242 A * 11/2000 Okumura et al. ..... 173/48
6,213,224 B1 * 4/2001 Furuta et al. ..... 173/217
6,431,289 B1 8/2002 Potter et al.
6,599,219 B2 * 7/2003 Pan ..... 475/317
6,655,470 B1 * 12/2003 Chen ..... 173/47
6,676,557 B2 * 1/2004 Milbourne et al. ..... 475/286

FOREIGN PATENT DOCUMENTS

DE 199 00 766 A1 7/1999

* cited by examiner

*Primary Examiner*—Scott A. Smith
(74) *Attorney, Agent, or Firm*—Lahive & Cockfield, LLP; Anthony A. Laurentano, Esq.

(57) ABSTRACT

A battery-operated driver-drill (1) includes an epicycle reduction gear unit (8) which encases a switchover sleeve (26) having inner teeth (27) and outer teeth (28). The gear unit (8) is rotatably mounted on second and third internal gears (19, 20) and integrally slidably connected with a slide plate (37). By operating the slide plate (37), the switchover sleeve (26) may be slid between a first position, in which the slide plate (37) engages one of the second and third internal gears (19, 20) while engaging axial ridges (29) of a first gear case (5), and a second position, in which the slide plate (37) simultaneously engages both the second internal gear (19) and a first carrier (10) adjacent to the second internal gear (19) while disengaged from the axial ridges (2).

16 Claims, 8 Drawing Sheets

First Speed

Second Speed

Third Speed

ELECTRIC POWER TOOL WITH IMPROVED SPEED CHANGE GEARING

RELATED APPLICATION

This application claims priority on Japanese Patent Application No. 2003-31542 filed on Feb. 7, 2003.

BACKGROUND OF THE INVENTION

1. Field of the Invention

The present invention generally relates to electric power tools. More particularly, the present invention relates to an electric power tool, such as an electric screwdriver or driver-drill, employing an epicycle reduction gear unit to provide three-speed transmission for the spindle.

2. Description of the Related Art

A known type of electric screwdriver includes a housing, a motor, and an epicycle reduction gear unit with a plurality of axially arranged stages each including an internal gear, a plurality of planetary gears revolving on the internal gear, and a carrier supporting the planetary gears. Attached to the front end of the housing in this known tool is a spindle to which the rotation of the motor is transmittable via the reduction gear unit, which also reduces the speed of the rotation during the transmission.

U.S. Pat. No. 6,431,289, the content of which is incorporated herein by reference, discloses such an electric screwdriver that employs a speed change mechanism to allow the operator to select from three rotational speeds for the spindle. More particularly, two internal gears within the epicycle reduction gear unit are disposed so as to be axially slidable between two positions. Further, a selector is operated from the outside of the housing to switch the positions of the internal gears. This causes integral or independent rotation of the planetary gears and the carriers depending on the positions of the internal gears so as to provide three spindle speeds.

While the foregoing arrangement achieves its intended objective, it is not free from certain problems and inconveniences. For example, the speed change mechanism must move the two internal gears to perform its function. Additionally, to effect such movement, a wire clip mounted on each of the two internal gears is fitted in a cam groove in a selector cam. This selector cam is provided outside a sleeve that houses the reduction gear unit. The selector cam in turn is moved in axial directions with a switch member mounted outside the cam. Accordingly, this arrangement significantly increases the number of components required and thus complicates the structure and the assembly of the power tool.

SUMMARY OF THE INVENTION

In view of the above-identified problems, an important object of the present invention is to provide an electric power tool that employs a simpler structure to provide three spindle speeds.

The above objects and other related objects are realized by the invention, which provides an electric power tool comprising: a housing; a motor encased in the housing and having an output shaft producing a torque; a spindle provided at a front end of the housing, the spindle receiving the torque and capable of rotation; and an epicycle reduction gear unit provided between the output shaft of the motor and the spindle. The epicycle reduction gear unit in turn includes front and rear internal gears axially arranged and independently rotatable with respect to each other, front and rear carriers, and gear sets each including a front planetary gear having a first diameter and a rear planetary gear having a second diameter different from the first diameter, the front and rear planetary gears being supported on the front carrier so as to revolve on inner peripheral surfaces of the front and rear internal gears, respectively. The electric power tool further comprises a switchover means slidably provided on outer peripheral surfaces of the internal gears and responsive to slide operation of the switchover means performed from outside of the housing for selectively prohibiting rotation of the internal gears relative to the housing. The switchover means is capable of coupling one of the two internal gears to the one of the carriers so as to permit integral rotation of the coupled internal gears with the coupled carriers. Further, the switchover means enables the spindle to rotate at a first speed by prohibiting rotation of one of the internal gears relative to the housing; at a second speed by prohibiting rotation of the other of the internal gears relative to the housing; and at a third speed by simultaneously permitting rotation of one of the internal gears relative to the housing and coupling that rotation-permitted internal gear to one of the carriers. As described above, according to the electric power tool of the present invention, three-speed transmission is provided simply by prohibiting rotation of one of the internal gears and selectively connecting one of the internal gears with the output shaft or the carrier, instead of achieving such transmission by sliding the internal gears. This reduces the number of components and the assembly steps required as well as the manufacturing costs, while ensuring reliable speed change operation. In particular, the present invention requires only a single-stage gear set including a carrier that supports two-tier planetary gears and two internal gears in order to provide three speeds. This advantageously reduces the number of gear sets compared to the conventional structure, thus effectively simplifying the transmission structure.

According to one aspect of the present invention, the electric power tool further comprises a slide member provided in the housing and capable of being slidably operated in axial directions. In addition, the switchover means may include an axially movable switchover sleeve mounted on the outer peripheral surfaces of the internal gears and connected to the slide member so as to allow the switchover sleeve and the slide member to move integrally in the axial directions. Furthermore, slide operation of the slide member causes the switchover sleeve to move to: a first slide position in which the switchover sleeve engages the front internal gear while engaging the housing; a second slide position in which the switchover sleeve engages the rear internal gear while engaging the housing; and a third slide position in which the switchover sleeve simultaneously engages the rear internal gears and the rear carrier while disengaged from the housing. This provides a simply constructed switchover means. In addition, this enhances the usability of the power tool as the speed change is effected by simple axial movement of the slide member.

According to another aspect of the present invention, the switchover sleeve is disposed radially inside of the slide member and includes an annular groove provided in an outer peripheral surface thereof, whereas the slide member includes a plurality of pins which penetrates the slide member and are inserted in the annular groove of the switchover sleeve in a manner that allows rotation of the switchover sleeve relative to the slide member while permitting axial slide movement of the sleeve integrally with the slide member.

According to still another aspect of the present invention, the electric power tool further comprises: a first internal gear disposed adjacent to and rear of the rear carrier; a plurality of first planetary gears engaging and capable of revolving on an inner peripheral surface of the first internal gear; and a pinion mounted on the output shaft of the motor and engaging the first planetary gears. The rear carrier may be disposed between the first internal gear and the rear internal gear.

According to yet another aspect of the present invention, the electric power tool further comprises a third carrier disposed forward of the front carrier, and the spindle is coupled to the third carrier.

According to one feature of the present invention, the electric power tool further comprises a clutch assembly provided around the spindle forward of the third carrier for disengaging and interrupting the transmission of the torque to the spindle when a load exerted on the spindle exceeds a user-set value.

According to another feature of the present invention, the electric power tool further comprises a clutch assembly provided around the spindle forward of the front carrier for disengaging and interrupting the transmission of the torque to the spindle when a load exerted on the spindle exceeds a user-set value.

In one embodiment of the invention, the electric power tool further comprises a slide member provided in the housing and capable of being slidably operated in axial directions. Additionally, the switchover means includes a switchover ring axially aligned with the two internal gears, and one of the internal gears is interposed between the switchover ring and the other internal gear In this embodiment, the switchover ring is rotatable and axially slidable between a first engagement position in which the switchover ring engages only the internal gear proximate to the switchover ring, and a second engagement position in which the switchover ring simultaneously engages the proximate internal gear and the carrier proximate to the ring, and the switchover ring is biased to the first engagement position under normal operating conditions. Moreover, the switchover means further includes an engagement element connected to the slide member so as to allow the engagement element and the slide member to move integrally in the axial directions, the engagement element being capable of selectively engaging the front and rear internal gears and the switchover ring. Further, slide operation of the slide member causes the engagement element to move to: a first slide position in which the engagement element engages the internal gear distal to the switchover ring and prohibits rotation of the distal internal gear relative to the housing; a second slide position in which the engagement element engages and prohibits rotation of the proximate internal gear relative to the housing; and a third slide position coincidental with the second engagement position, in which the engagement element engages the switchover ring. The foregoing arrangement provides a simply constructed switchover means. In addition, this enhances the usability of the power tool as the speed change is effected by simple axial movement of the slide member.

According to still another feature of the present invention, the switchover ring is located forward of the front and rear internal gears adjacent to the front internal gear, such that the front internal gear is the proximate internal gear and the rear internal gear is the distal internal gear. Furthermore, when slid from the second slide position to the third slide position, the engagement element abuts and moves the switchover ring into engagement with the front carrier.

According to yet another feature of the present invention, the engagement element is configured to axially slide along and engage the first and second internal gears and the switchover ring so as to selectively prohibit rotation of the internal gears and the switchover ring. In one embodiment, the engagement element is a pin.

According to one practice of the present invention, the electric power tool further comprises a third carrier disposed forward of the front carrier, and the spindle is coupled to the third carrier.

According to another practice of the present invention, the first diameter is greater than the second diameter.

Other general and more specific objects of the invention will in part be obvious and will in part be evident from the drawings and descriptions which follow.

BRIEF DESCRIPTION OF THE ATTACHED DRAWINGS

For a fuller understanding of the nature and objects of the present invention, reference should be made to the following detailed description and the accompanying drawings, in which.

DETAILED DESCRIPTION OF THE PREFERRED EMBODIMENTS

Preferred embodiments of the present invention will be described hereinafter with reference to the attached drawings.

Embodiment 1

Figure 1:
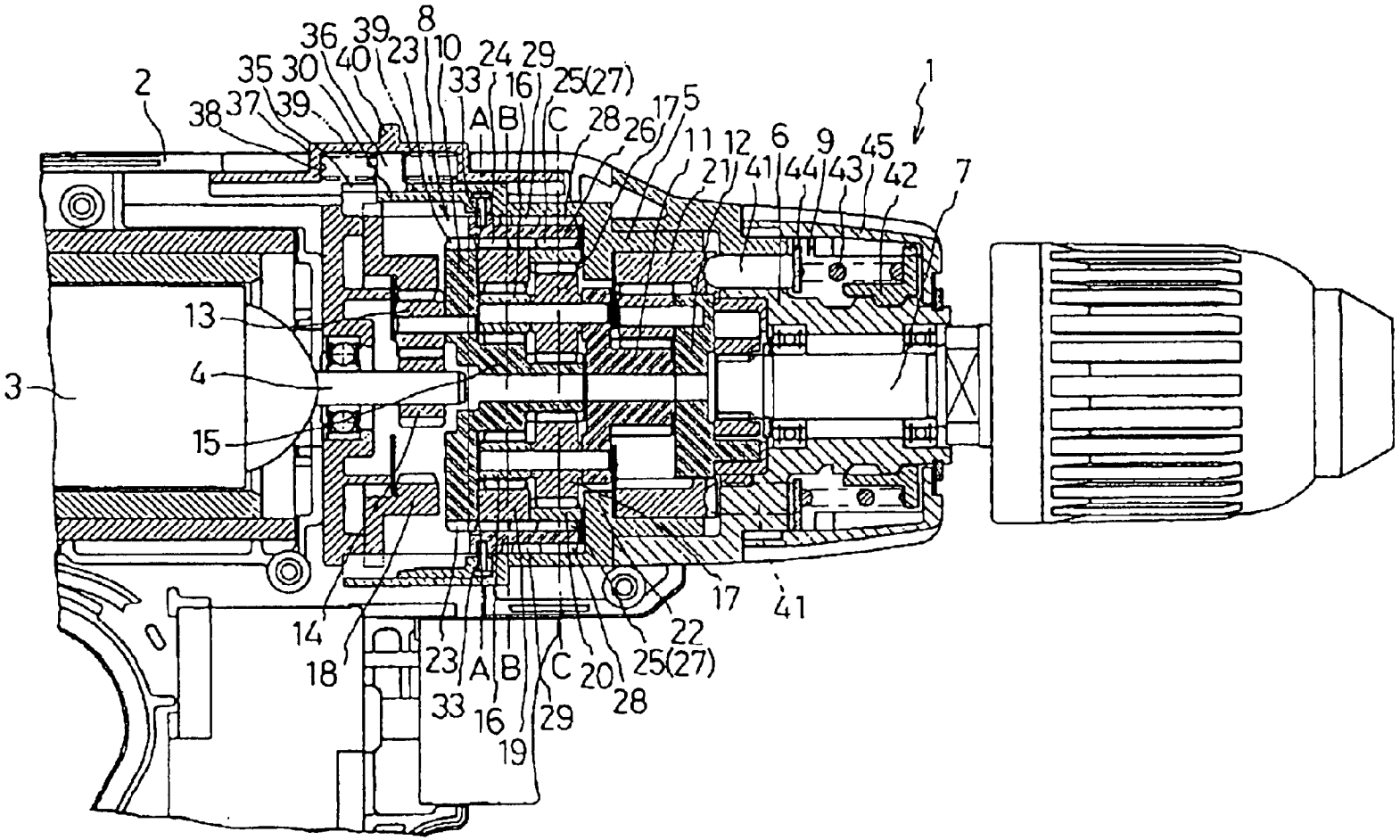
FIG. 1 is a partially cross-sectional side view of an essential part of a battery-powered driver-drill constructed according to the teachings of the present invention.

FIG. 1 is a partially cross-sectional side view of an essential part of a battery-powered driver-drill 1 constructed according to the teachings of the present invention. The driver-drill 1 includes a housing 2, a motor 3 with an output shaft 4 both encased in the housing 3, a first gear case 5 having a multiple-stepped cylindrical shape provided forward (to the right-hand side in the drawing) of the motor 3, and a second gear case 6 that is also provided forward of the motor 3 and rotatably supports a spindle 7 of the tool 1. The driver-drill 1 further includes a clutch assembly 9 mounted forward of the second gear case 6 and an epicycle reduction gear unit 8 within the first gear case 5 and the second gear case 6. The epicycle reduction gear unit 8 includes three axially arranged stages of first, second, and third carriers 10, 11, and 12, respectively, each supporting three or four planetary gears on its rear face. Planetary gears 13 associated with the first carrier 10 revolve on a first internal gear 18. As the planetary gears 13 engage a pinion 14 fitted on the output shaft 4 of the motor 3 and the third carrier 12 is secured to the spindle 7, the epicycle reduction gear unit 8 is capable of transmitting the torque from the output shaft 4 to the spindle 7 while reducing the rotational speed.

Figure 2:
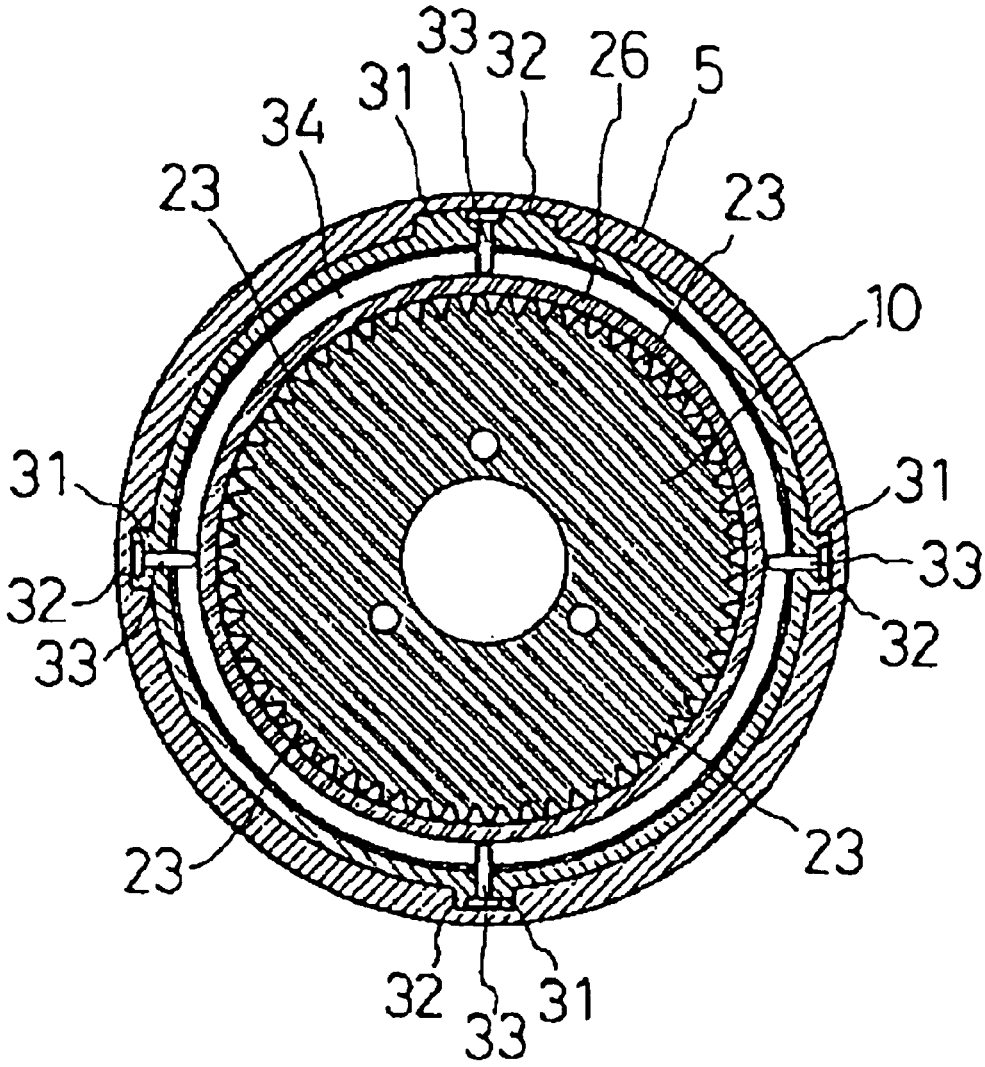
FIG. 2 is a cross-sectional view of the first gear case and the internal mechanisms therein of the driver-drill of FIG. 1 taken on line A—A.
Figure 3:
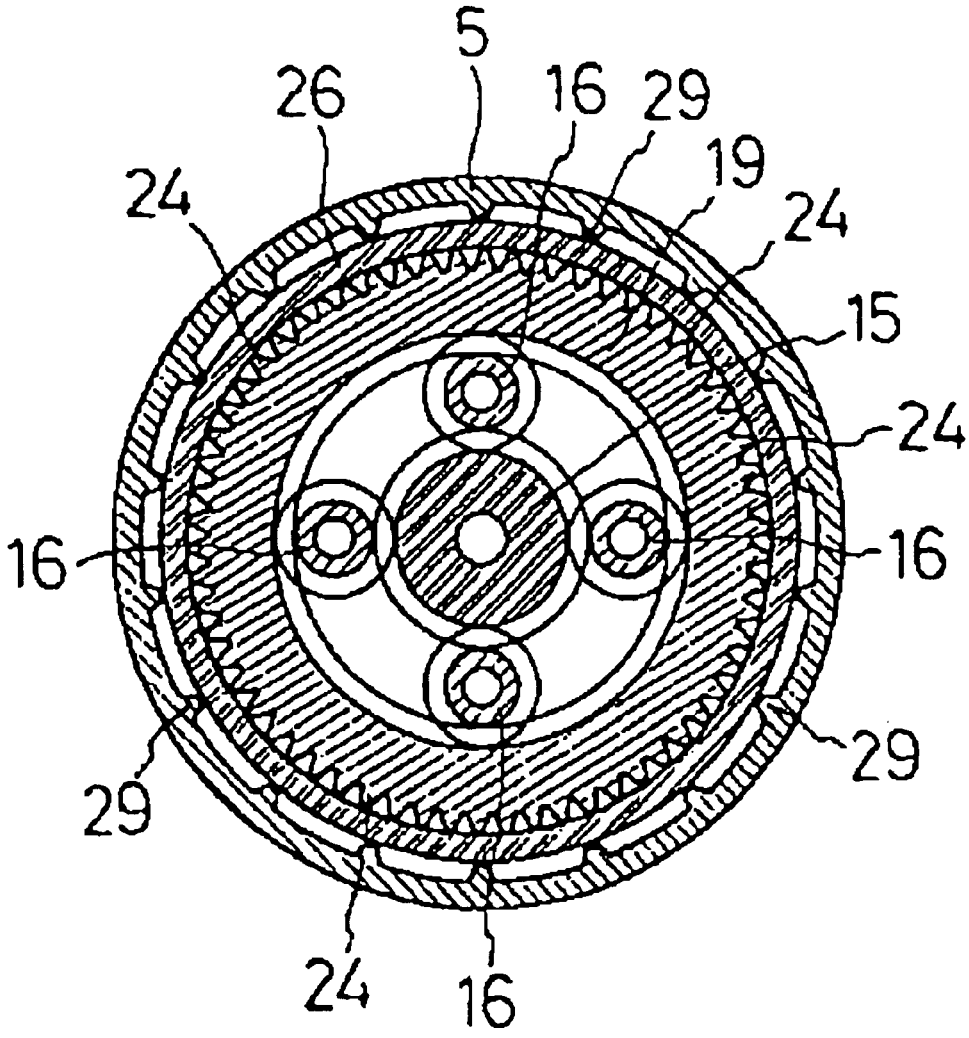
FIG. 3 is a cross-sectional view of the first gear case and the internal mechanisms therein of the driver-drill of FIG. 1 taken on line B—B.
Figure 4:
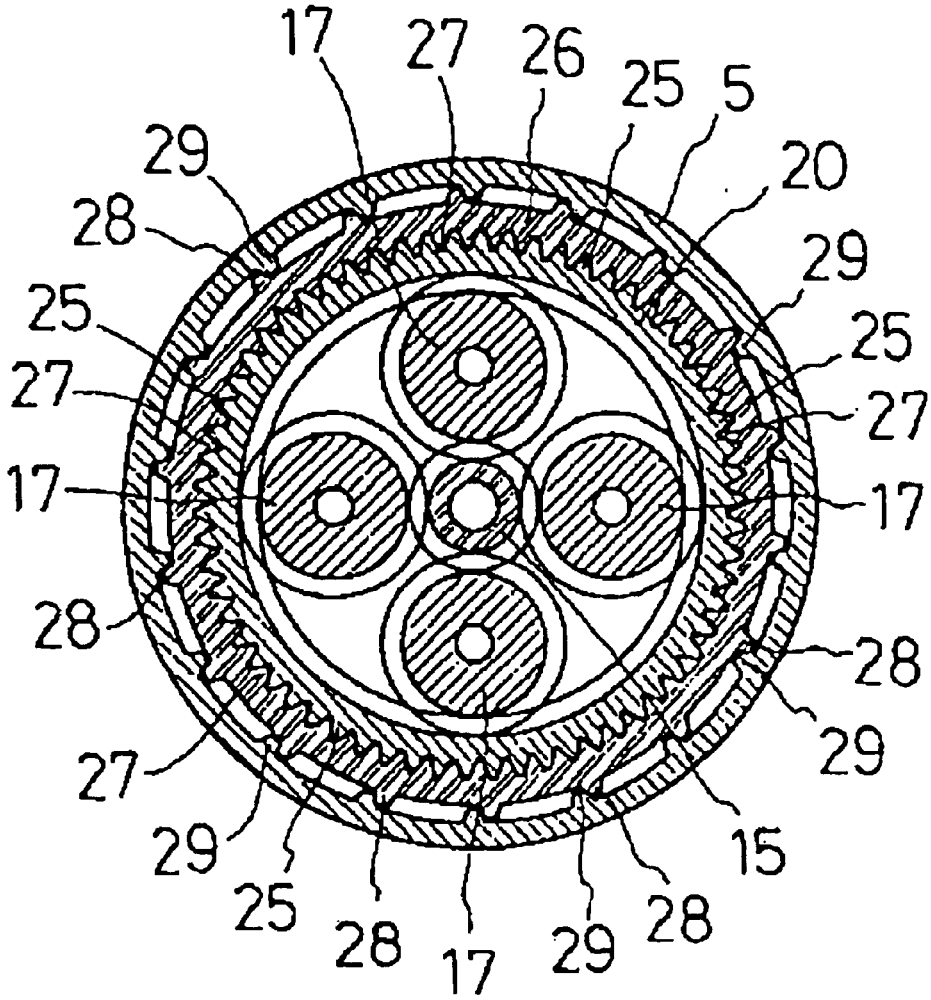
FIG. 4 is a cross-sectional view of the first gear case and the internal mechanisms therein of the driver-drill of FIG. 1 taken on line C—C.

The first carrier 10 includes an output shaft 15 which has a rear large diameter section and a forward small diameter section. In mesh with these two sections are sets of one small diameter gear 16 and one large diameter gear 17 supported by the second carrier 11 in a manner that permits each gear in a gear set to rotate independently from the other gear in the same gear set. Each large diameter gear 17 is coaxially disposed on a small diameter gear 16 so that the gear 16 engages the large diameter section of the output shaft 15 and the gear 17 engages the small diameter section. Accordingly, the second stage includes a second internal gear 19 on which the small diameter gears 16 revolve and a third internal gear 20 on which the large diameter gears 17 revolve, with the two internal gears 19 and 20 axially arranged back to back. The second and third internal gears 19 and 20 have the same outer diameter as that of the first carrier 10 and are prohibited from axially moving beyond the range defined between an internal wall 22 of the first gear case 5 and the first carrier 10. In addition, these internal gears 19 and 20 are capable of rotation independently from each other. Referring also to FIGS. 2–4, which show cross-sectional views of the first gear case 5 and its internal mechanisms taken on lines A—A, B—B, and C—C, respectively, the first carrier 10 and the two internal gears 19 and 20 each has on its outer peripheral surface the same number of identically profiled axial teeth, denoted by reference numbers 23–25, respectively, in the drawings.

The power tool 1 additionally includes a switchover sleeve 26 fitted around the second and third internal gears 19 and 20 in a manner that permits the sleeve's rotation and axial movement with respect to the housing 2. Referring to FIG. 4, the switchover sleeve 26 includes, on the front portion of the sleeve's inner surface, a plurality of inner teeth 27 that are capable of separately engaging the teeth 23-25 of the first carrier 10 and the second and third internal gears 19 and 20, respectively. The switchover sleeve 26 additionally includes a plurality of outer teeth 28 at regular circumferential intervals on the front portion of the sleeve's outer surface, with each tooth 28 having approximately the same axial length as the inner tooth 27. The outer teeth 28 engage axial ridges 29 provided around the inner peripheral surface of the first gear case 5 so as to limit the rotation of the switchover sleeve 26. It should be noted that the axial ridges 29 extend rearward close to the transverse plane in which the front ends of the axial teeth 24 of the second internal gear 19 are located.

Provided at the rear of the switchover sleeve 26 within the first gear case 5 is a connecting sleeve 30 which has a larger outer diameter than the switchover sleeve 26. As shown in FIG. 2, the connecting sleeve 30 includes around its outer peripheral surface four axial ridges 31 that fit in complementary grooves 32 in the inner surface of the first gear case 5 so as to prohibit the rotation of the sleeve 30 with respect to the gear case 5 and permit axial slide of the sleeve 30 of the sleeve 30 with respect to the case 5. The connecting sleeve 30 further includes at its front end four pins 33 radially penetrating thereof at regular intervals toward the axis thereof. The top ends of the pins 33 are inserted in an annular groove 34 provided in the outer rear peripheral surface of the switchover sleeve 26, thus allowing the rotation of the sleeve 26 independently from the connecting sleeve 30 while causing integral movement of the sleeve 26 with the sleeve 30 in the axial directions.

In the axial stroke of the connecting sleeve 30 and the switchover sleeve 26, at the forward slide position (see FIG. 5A), the front end of the connecting sleeve 30 abuts the inner wall 22 of the first gear case 5 so as to provide a first speed. At this first speed position, the internal teeth 27 of the switchover sleeve 26 engage and mesh with the teeth 25 of the third internal gear 20, whereas the outer teeth 28 engage the ridges 29 of the first gear case 5. When the connecting sleeve 30 and the switchover sleeve 26 are at the rearmost slide position (see FIG. 5C), the rear end of the switchover sleeve 26 is located adjacent to the first internal gear 18 so as to produce a third speed. At this third speed position, the inner teeth 27 of the switchover sleeve 26 span and simultaneously engage the teeth 23 of the first carrier 10 and the teeth 24 of the second internal gear 19, whereas the outer teeth 28 are disengaged from the ridges 29. At the intermediate slide position between the first and second speed positions (see FIG. 5B), the inner teeth 27 of the switchover sleeve 26 engage only the teeth 24 of the second internal gear 19 while the outer teeth 28 engage the ridges 29 so as to provide a second speed.

Furthermore, a connector protrusion 36 is provided on the rear upper surface of the connecting sleeve 30, passing though an axial slit 35 provided in the rear end of the first gear case 5. The connector protrusion 36 is coupled to a slide member, such as a slide plate 37, which is slidably disposed on the housing 2 and has a slide tab 40 projecting from the upper surface of the plate 37. The connector protrusion 36 is coupled to the slide plate 37 by insertion of the protrusion 36 into a recess 38 provided in the undersurface of the slide plate 37 and interposition of the protrusion 36 between front and rear coil springs 39 in the recess 38. By manually pinching the tab 40 and moving the tab 40 forward and backward, the user can axially slide the connecting sleeve 30 and thus the switchover sleeve 26 from the outside of the power tool 1.

The following describes in detail the construction and operation of the clutch assembly 9. The third stage includes a forth internal gear 21 rotatably disposed within the second gear case 6. A plurality of pins 41 penetrate the second gear case 6 and abut the front face of the fourth internal gear 21. In addition, these pins 41 are biased rearward by a coil spring 43 via a washer 44, with the spring 43 interposed between the washer 44 and a spring holder 42 screwed onto the second gear case 6. Accordingly, the biasing force of the coil spring 43 acts on the fourth internal gear 21 via the pins 41, thus preventing rotation of the gear 21 relative to the pins 41, as long as the load exerted on the spindle 7 remains below the torque required to disengage the clutch as previously set by manually adjusting the biasing force of the coil spring 43. When the aforementioned load exceeds the previously set torque, for example at the end of a screw-tightening operation, the front face of the fourth internal gear 21 rides over the pins 41 and rotates idly (i.e., the clutch slips), thus interrupting the transmission of the torque to the spindle 7 (hereafter referred to as the driver mode operation).

With reference to FIGS. 1, 5, 6, and 8, mounted on the second gear case 6 is a change ring 45 manually rotatable to feed the spring holder 42 in the axial directions, thereby adjusting the biasing force of the coil spring 43 and thus the torque value at which the clutch is disengaged or slips in the driver mode. It should be noted that when the spring holder 42 is moved to the rearmost position, where its rear end comes into abutment with the washer 44, the front face of the fourth internal gear 21 is prevented from riding over the pins 41, thus placing the tool 1 into a drill mode in which the spindle 7 continues to rotate irrespective of the load applied thereto.

Figure 5A:
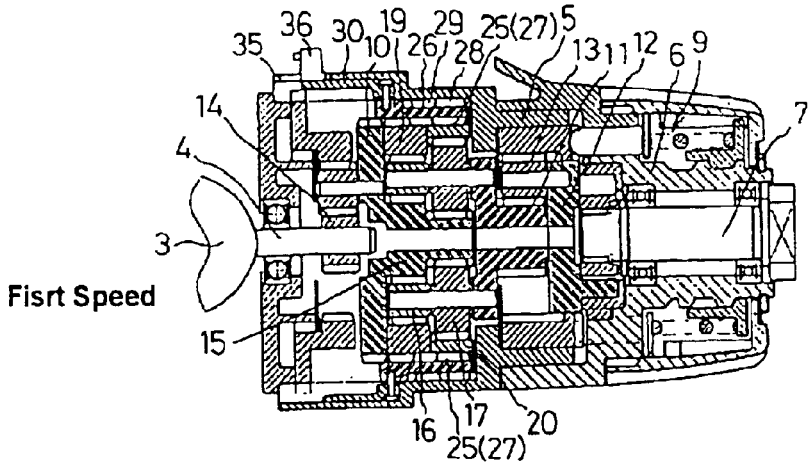
FIG. 5A shows the operation of the switchover mechanism of the driver-drill shown in FIG. 1 in selection of a first speed.

In the operation of a driver-drill 1 constructed according to the above, when the slide plate 37 is moved to the first speed position shown in FIG. 5A by means of the slide tab 40, the connecting sleeve 30 and the switchover sleeve 26 are moved to the forward position as described above, causing the switchover sleeve 26 to engage both the first gear case 5 and the third internal gear 20. This causes the first carrier 10 and the second internal gear 19 to become freely rotatable, with the third internal gear 20 secured and prevented from rotation. When the motor 3 is activated in this condition, the rotation of the output shaft 4 is transmitted to the first carrier 10 via a pinion 14. Of the planetary gears engaging the output shaft 15 of the carrier 10, the small diameter gears 16 are not caused to directly revolve while in mesh with the second internal gear 19, as the gear 19 is located radially outside of the small diameter gears 16 and currently freely rotatable. Conversely, the large diameter gears 17 are caused to revolve directly as they are in mesh with the third internal gear 20, which are currently secured and prevented from movement. Subsequently, the second carrier 11 rotates in response to the revolution of the large diameter gears 17. This causes the planetary gears 13 of the next stage to revolve, thus rotating the third carrier 12 and the spindle 7, which is integral with the third carrier 12. In the first speed position, as the rotation of the output shaft 4 is transmitted to the second carrier 11 via the large diameter gear 17, the spindle 7 rotates at the lowest speed.

Figure 5B:
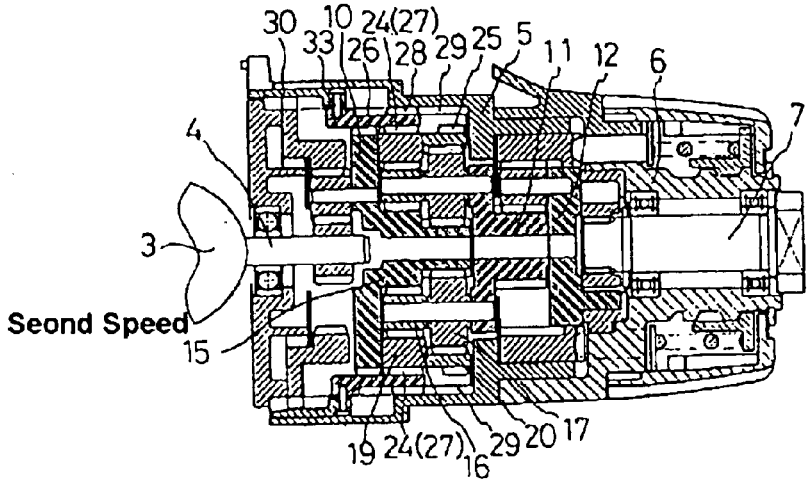
FIG. 5B shows the operation of the switchover mechanism of the driver-drill shown in FIG. 1 in selection of a second speed.

When the slide plate 37 is slid to the second speed position shown in FIG. 5B, the connecting sleeve 30 and the switchover sleeve 27 move to the intermediate position as described above. In this position, the switchover sleeve 26 engages both the first gear case 5 and the second internal gear 19, permitting the first carrier 10 and the third internal gear 20 to rotate freely while securing the second internal gear 19 against movement. Accordingly, when the motor 3 is activated, the output shaft 15 of the first carrier 10 causes direct revolution of only the small diameter gears 16. Subsequently, the second carrier 11 rotates in response to the revolution of the small diameter gears 16. The manner in which the rotation is transmitted subsequent to the second carrier 11 is the same in this position as in the first speed position. However, in the second speed position, as the rotation is transmitted to the second carrier 11 via the small diameter gears 16, the spindle 7 has a higher rotational speed than in the first speed position.

Figure 5C:
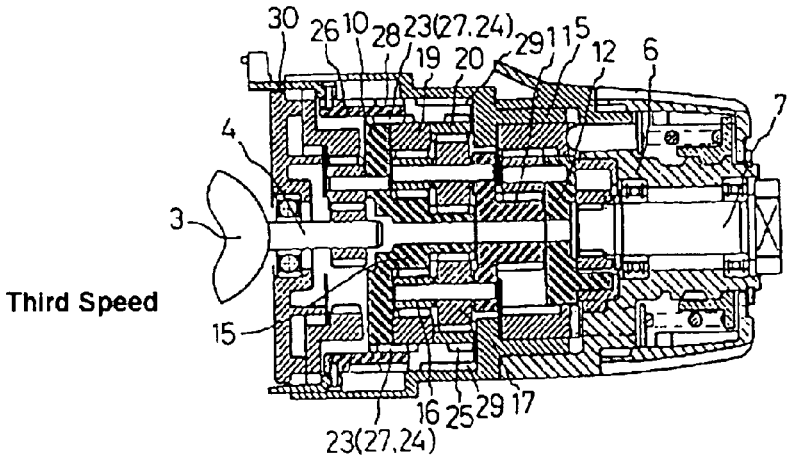
FIG. 5C shows the operation of the switchover mechanism of the driver-drill shown in FIG. 1 in selection of a third speed.

When the slide plate 37 is slid to the third speed position shown in FIG. 5C, the connecting sleeve 30 and the switchover sleeve 27 move to the rearmost position as described above. In this position, the switchover sleeve 26 engages both the first carrier 10 and the second internal gear 19 while disengaging from the ridges 29. This integrates the second internal gear 19 and the small diameter gears 16 with the first carrier 10, directly coupling the first carrier 10 with the second carrier 11. Accordingly, when the motor 3 is activated, the first carrier 10 and the second carrier 11 rotate at the same speed. The manner in which the rotation is transmitted subsequent to the second carrier 11 is the same in this position as in the second speed position. However, in the third speed position, as no speed reduction is performed between the first carrier 10 and the second carrier 11, the spindle 7 rotates at the highest speed.

As described above, according to the battery-operated driver-drill 1 of the foregoing first embodiment, the rotation of the second and third internal gears 19 and 20 is independently controllable by a switchover means (i.e., the switchover sleeve 26). Moreover, the switchover means couples the second internal gear 19 to the adjacent first carrier 10 so as to permit integral rotation of the gear 19 with the carrier 10. This arrangement provides three speeds simply by changing the connection among the first carrier 10, the second internal gear 19, and third internal gear 20 without requiring sliding of the internal gears 18–21. This reduces the number of components and the assembly steps required as well as the manufacturing costs, while ensuring reliable speed change operation. In particular, the present invention may require only a single stage gear set including a carrier that supports two-tier planetary gears (i.e., front and rear planetary gears) and two internal gears in order to provide three speeds. This advantageously reduces the number of gear sets compared to the conventional structure, thus effectively simplifying the gear structure.

In the foregoing embodiment, the switchover means includes the switchover sleeve 26 in combination with the slide plate 37, whereby the slide plate 37 is manually operated to slide the sleeve 26 to any of the three positions. This provides easy operability and a simple and effective arrangement for selecting a desired speed from the three available speeds.

Furthermore, as the speed change gear is disposed in an earlier stage (i.e., closer to the output shaft 4) than the clutch assembly 9, there is no possibility that switching operation of the speed change gear inadvertently changes the user-preset torque value at which the clutch disengages, thereby further enhancing the ease of use of the tool.

In the foregoing first embodiment, the third speed is provided by the switchover sleeve 26 engaging both the first carrier 10 and the second internal gear 19 when the switchover sleeve 26 is in the rearmost position. However, the third speed may also be provided by forwardly extending the stroke of the sleeve 26 so that the sleeve 26 will be disengaged from the ridges 29 forward of the location of the sleeve's engagement with the third internal gear 20 and engage teeth provided on the third internal gear 20 and the second carrier 11, thus causing the integral rotation of the internal gear 20 and the second carrier 11.

In the foregoing embodiment, although the switchover means of the invention has been described as being employed with the epicycle reduction gear unit 8 having three stages, the switchover means can be employed with a single stage gear set including a carrier that supports front and rear planetary gears and two internal gears. This means that the present invention can be used in combination not only with a two-stage gear set but with a single-stage gear set. For example, application of the invention with a single-stage gear set merely requires that the pinion attached to the motor's output shaft have the same geometry as the first carrier 10 of the embodiment. Furthermore, as described above, in order to connect an internal gear with a carrier adjacent to and forward of the internal gear when the switchover sleeve is in the forward position, the pinion on the output shaft may be constructed with two diameters and an intermediate step.

In the first embodiment 1, the switchover sleeve 26 is coupled to the slide plate 37 with the connecting sleeve 30 elastically supported between the coil springs 39 so that the switchover sleeve 26 may smoothly slide and engage the internal gears 19, 20 and the first carrier 10 while minimizing possible damage to the respective gear's teeth. It should be noted, however, that the connecting sleeve 30 may be omitted. In that case, the switchover sleeve 26 may be directly connected with a slide member (such as the slide plate) for example by inserting a pin disposed on the underside of the slide member into the annular groove of the switchover sleeve 26.

Embodiment 2

An alternate structure of the present invention is described hereinafter with reference to the attached drawings, in which identical or similar reference numerals or characters denote identical or similar parts or elements throughout the several views. Therefore, description of such elements is omitted in the following description.

Figure 6:
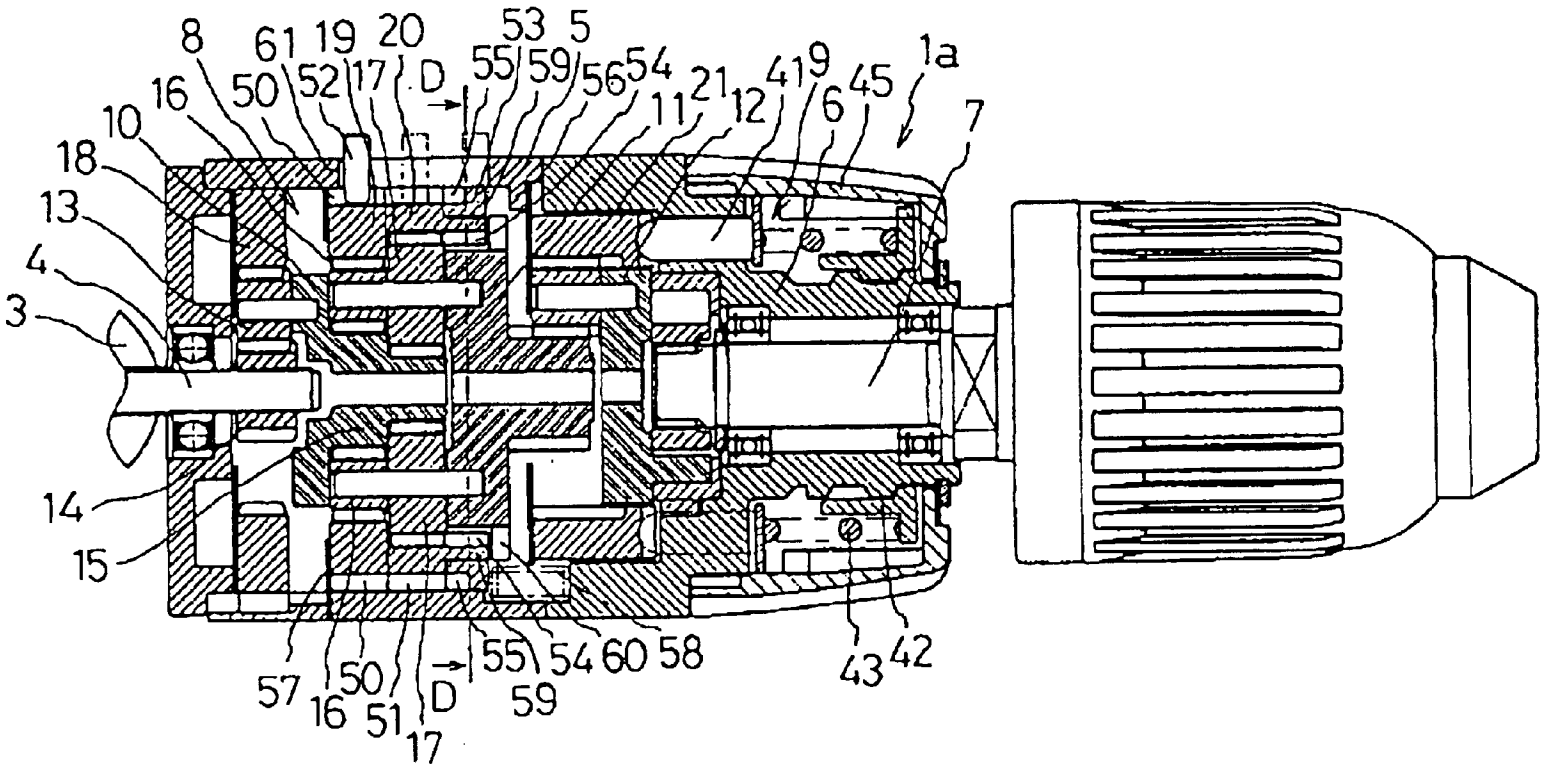
FIG. 6 is a partially cross-sectional side view of an essential part of a battery-powered driver-drill according to a second embodiment of the present invention.
Figure 7:
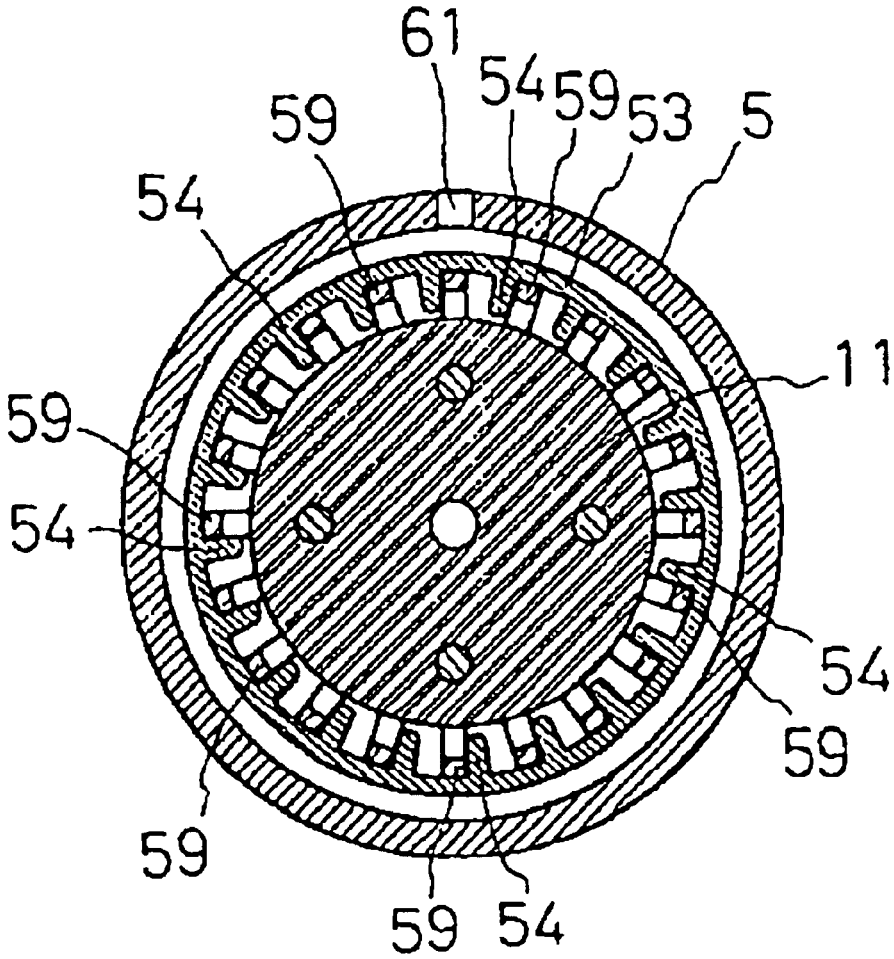
FIG. 7 is a cross-sectional view of the first gear case and the internal mechanisms therein of the driver-drill of FIG. 6 taken on line D—D.

FIG. 6 is a partially cross-sectional side view of an essential part of a battery-powered driver-drill 1*a* constructed according to the teachings of the present invention. As in the first embodiment, the driver-drill 1*a* includes the second carrier 11 with the small diameter gears 16 and the large diameter gears 17 within the epicycle reduction gear unit 8. However, the second and third internal gears 19 and 20 include on their outer peripheral surfaces teeth 50 and 51, respectively, that are sufficiently spaced apart to receive an engagement element, such as a pin 52, therebetween. Additionally, as shown in FIG. 7, a switchover ring 53 is rotatably disposed forward of the third internal gear 20 outside the second carrier 11. The switchover ring 53 includes internal radial teeth 54 at regular intervals on its inner peripheral surface and outer teeth 55 on the rear half portion of the outer peripheral surface thereof. The outer teeth 55 are of identical shape as the teeth 50 and 51 of the second and third internal gears 19 and 20.

Moreover, the switchover ring 53 is axially movable between a rearmost position (the first engagement position) shown in FIG. 6, in which the ring 53 abuts the second and third internal gears 19 and 20, which are prevented from further rearward movement by a washer 57, and a forward position (the second engagement position) in which the ring 53 abuts a stopper 56 protruding from the inner wall of the first gear case 5. A biasing means, such as a plurality of coil springs 58, is disposed forward of the switchover ring 53 between the ring 53 and the rear face of the second gear case 6 so as to bias the ring 53 to the rearmost position of FIG. 6 under the normal operating conditions. Those with ordinary skill in the art will appreciate that the biasing means is not limited to the coil springs 58 as in this embodiment and may be replaced by other types of springs, such as blade springs, flat springs, or plate springs, disc springs, or a piece of elastic material protruding from the first gear case 5, without departing from the scope of the present invention.

Referring now to FIGS. 6–8, a plurality of engagement projections 59 are provided at regular circumferential intervals on the front face of the third internal gear 20 so as to engage the inner teeth 54 of the switchover ring 53. The projections 59 are oriented in the forward direction and have a width approximately one half the interval between two inner teeth 54 (FIG. 7). The length of the engagement projections 59 is determined such that the projections 59 do not disengage from the switchover ring 53 regardless of the position of the ring 53. For instance, when the switchover ring 53 is in the forward position, the rear halves of the inner teeth 54 of the ring 53 remain in engagement with the projections 59.

Moreover, the second carrier 11 includes, at regular circumferential intervals on its periphery, a plurality of axial projections 60 that are capable of engaging the inner teeth 54 of the switchover ring 53. In particular, the projections 60 engage the inner teeth 54 forward of the engagement projections 59 of the third internal gear 20. Accordingly, when the switchover ring 53 is in the forward position, the internal teeth 54 of the switchover ring 53 engage both the projections 59 of the third internal gear 20 and the projections 60 of the second carrier 11 and thus integrate the gear 20 and the carrier 11. However, when the switchover ring 53 is in the rearmost position, the internal teeth 54 of the ring 53 disengage from the projections 20 while remaining in engagement with the projections 59.

Figure 8A:
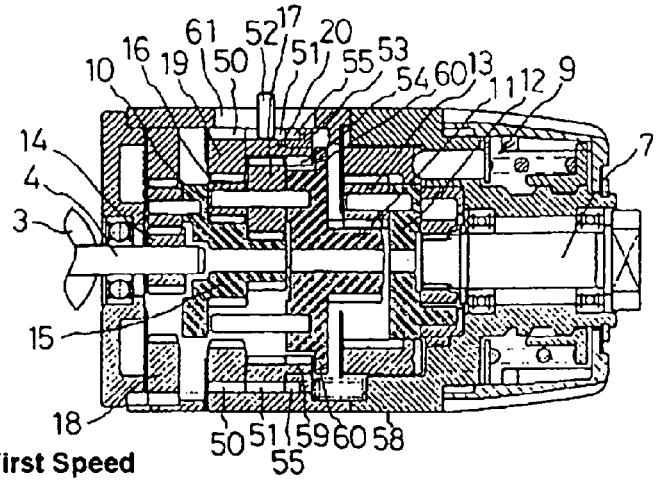
FIG. 8A shows the operation of the switchover mechanism of the driver-drill shown in FIG. 6 in selection of a first speed.
Figure 8B:
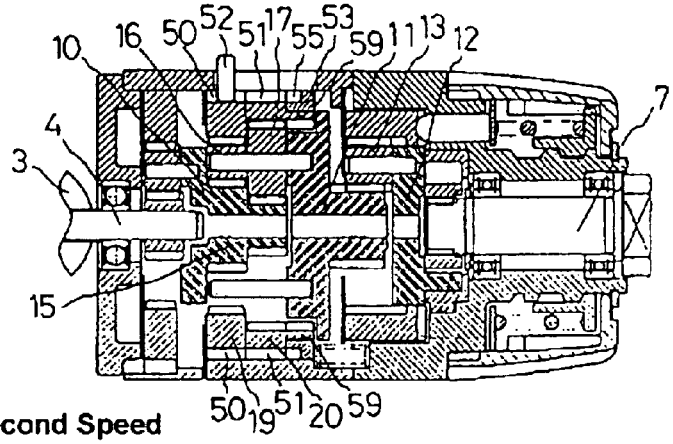
FIG. 8B shows the operation of the switchover mechanism of the driver-drill shown in FIG. 6 in selection of a second speed.
Figure 8C:
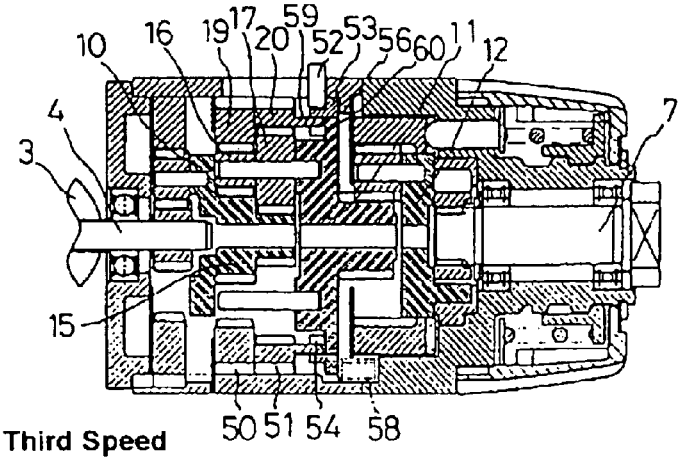
FIG. 8C shows the operation of the switchover mechanism of the driver-drill shown in FIG. 6 in selection of a third speed.

Referring to FIGS. 8A–8C, the pin 52 is passed through an axial slit 61 provided in the first gear case 5 and directly couples to the slide plate (not shown) or indirectly couples to the slide plate via front and rear coil springs that elastically support the pin 52 therebetween, as in the first embodiment. In this way, the pin 52 is permitted to move in the axial directions only along the slit 61. That is, the pin 52 is slidable though an intermediate position (the first speed position, shown in FIG. 8A) in which the pin 52 engages the teeth 51 of the third internal gear 20 only, a rearmost position (the second speed position, shown in FIG. 8B) in which the pin 52 engages the teeth 50 of the second internal position 19 only, and a forward position (the third speed position, shown in FIG. 8C) in which the pin 52 engages the outer teeth 55 of the switchover ring 53 and advances the switchover ring 53 so as to integrate the third internal gear 20 with the second carrier 11.

In the operation of a driver-drill 1*a* constructed according to the above, when the slide plate is moved to the first speed position shown in FIG. 8A, the pin 52 moves to the intermediate position, fixing the third internal gear 20 only and allowing the second internal gear 19 to rotate freely. When the motor 3 is activated in this condition, the rotation of the output shaft 4 is transmitted to the first carrier 10 via the pinion 14. Of the planetary gears engaging the output shaft 15 of the carrier 10, the small diameter gears 16 are not caused to directly revolve as they are in mesh with the second internal gear 19, which is located radially outside thereof and currently freely rotatable. Conversely, the large diameter gears 17 are caused to directly revolve as they are in mesh with the third internal gear 20, which are currently secured and prevented from movement. Subsequently, the second carrier 11 rotates in response to the revolution of the large diameter gears 17. This causes the planetary gears 13 of the next stage to revolve, thus rotating the third carrier 12 and the spindle 7, which is integral with the third carrier 12. In the first speed position, as the rotation of the output shaft 4 is transmitted to the second carrier 11 via the large diameter gear 17, the spindle 7 rotates at the lowest speed.

When the slide plate is slid to the second speed position shown in FIG. 8B, the pin 52 moves to the rearward position as described above. This secures the second internal gear 19 against rotation while rendering the third internal gear 20 freely rotatable. Accordingly, when the motor 3 is activated, the output shaft 15 of the first carrier 10 causes direct revolution only of the small diameter gears 16 within the second internal gear 19. Subsequently, the second carrier 11 rotates in response to the revolution of the small diameter gears 16. The manner in which the rotation is transmitted subsequent to the second carrier 11 is the same in this position as in the first speed position. However, in the second speed position, as the rotation is transmitted to the second carrier 11 via the small diameter gears 16, the spindle 7 has a higher rotational speed than in the first speed position.

When the slide plate is slid to the third speed position shown in FIG. 8C, the pin 52 moves to the foremost position as described above. In this position, the switchover ring 53 is advanced to engage the second carrier 11. This integrates the third internal gear 20 and the large diameter gears 17 with the second carrier 11, directly coupling the first carrier 10 with the second carrier 11. Accordingly, when the motor 3 is activated, the first carrier 10 and the second carrier 11 rotate at the same speed. The manner in which the rotation is transmitted subsequent to the second carrier 11 is the same in this position as in the second speed position. However, in the third speed position, as no speed reduction is performed between the first carrier 10 and the second carrier 11, the spindle 7 rotates at the highest speed.

As described above, according to the driver-drill 1*a* of the foregoing second embodiment, three speed transmissions are provided simply by changing the connection among the second carrier 11, the second internal gear 19, and third internal gear 20 without sliding the internal gears 18–21. This reduces the overall number of components in the power tool and the assembly steps required as well as the manufacturing costs, while ensuring reliable speed change operation. In particular, the present invention may require only a single-stage gear set including a carrier that supports two-tier planetary gears (i.e., front and rear planetary gears) and two internal gears in order to provide three speeds. This advantageously reduces the number of gear sets compared to the conventional structure, thus effectively simplifying the transmission structure.

In the foregoing embodiment, the switchover means includes the pin 52 and the switchover ring 53 in combination with the slide plate, whereby the slide plate is, for example, manually operated to slide the pin to any of the three positions. This provides easy operability and a simple and effective arrangement for selecting a desired speed from the three available operating speeds.

Furthermore, as the speed change gear or mechanism is disposed in an earlier stage (i.e., closer to the output shaft 4) than the clutch assembly 9, manual operation of the speed change gear does not inadvertently change the user-preset torque value at which the clutch disengages or slips, thus enhancing the usability of the tool 1*a*.

As an alternate arrangement to the second embodiment, the switchover ring 52 may be disposed rear of the second internal gear 19 and biased forward by an appropriate biasing means, whereas radial projections identical to those of the second carrier 11 may be provided on the rear outer peripheral portion of the first carrier 10 and engagement projections similar to those of the third internal gear 20 may be provided on the rear face of the second internal gear 19. In this alternate arrangement, the third speed is provided by moving the switchover ring to a rearmost position rear of the second internal gear 19, in which the second internal gear 19 is connected with the first carrier 10. This arrangement minimizes the possibilities of selecting a wrong speed as the first, second, and third speed positions are arranged in that order with the first speed position being forward of the rest, thus further enhancing the ease of use of the tool.

In the second embodiment as well as in the first embodiment, the switchover means is applicable to a single-stage gear set as well as a two-stage gear set. For example, to apply the invention to a single-stage gear set, the pinion on the output shaft may be constructed with two diameters and an intermediate step. Furthermore, to connect an internal gear with a carrier adjacent to and rear of the internal gear when the switchover ring is in the rearmost position, radial projections similar to those on the second carrier 11 may be provided on the pinion of the output shaft, whereas flanges to which the switchover ring can engage in its rearmost position may be disposed on the radial projections.

In both of the first and second embodiments, the two-tier planetary gears provided in association with the switchover means (i.e., the large and small diameter gears) may be reversed, disposing the small diameter gears forward of the large diameter gears. Moreover, each set of large and small diameter gears may not be coaxially supported as in the foregoing embodiments; it is possible to support these gears on separate shafts having different axial lengths.

Equivalents

It will thus be seen that the present invention efficiently attains the objects set forth above, among those made apparent from the preceding description. As other elements may be modified, altered, and changed without departing from the scope or spirit of the essential characteristics of the present invention, it is to be understood that the above embodiments are only an illustration and not restrictive in any sense. The scope or spirit of the present invention is limited only by the terms of the appended claims.

Having described the invention, what is claimed as new and desired to be secured by Letters Patent is:

1. An electric power tool, comprising:

a housing;

a motor encased in the housing and having an output shaft producing a torque;

a spindle provided at a front end of the housing, the spindle receiving the torque and capable of rotation;

an epicycle reduction gear unit provided between the output shaft of the motor and the spindle, the epicycle reduction gear unit including front and rear internal gears axially arranged and independently rotatable with respect to each other, front and rear carriers, and gear sets each including a front planetary gear having a first diameter and a rear planetary gear having a second diameter different from the first diameter, the front and rear planetary gears being supported on the front carrier so as to revolve on inner peripheral surfaces of the front and rear internal gears, respectively; and switchover means slidably provided on outer peripheral surfaces of the internal gears and responsive to slide operation of the switchover means performed from outside of the housing for selectively prohibiting rotation of the internal gears relative to the housing, the switchover means being capable of coupling one of the two internal gears to the one of the carriers so as to permit integral rotation of the coupled internal gears with the coupled carriers, further wherein the switchover means enables the spindle to rotate at a first speed by prohibiting rotation of one of the internal gears relative to the housing;

at a second speed by prohibiting rotation of the other of the internal gears relative to the housing; and at a third speed by simultaneously permitting rotation of one of the internal gears relative to the housing and coupling that rotation-permitted internal gear to one of the carriers.

2. An electric power tool in accordance with claim 1 further comprising a slide member provided in the housing and capable of being slidably operated in axial directions, wherein the switchover means includes an axially movable switchover sleeve mounted on the outer peripheral surfaces of the internal gears and connected to the slide member so as to allow the switchover sleeve and the slide member to move integrally in the axial directions, and further wherein slide operation of the slide member causes the switchover sleeve to move to a first slide position in which the switchover sleeve engages the front internal gear while engaging the housing, a second slide position in which the switchover sleeve engages the rear internal gear while engaging the housing, and a third slide position in which the switchover sleeve simultaneously engages the rear internal gears and the rear carrier while disengaged from the housing.

3. An electric power tool in accordance with claim 2, wherein the switchover sleeve is disposed radially inside of the slide member and includes an annular groove provided in an outer peripheral surface thereof, and further wherein the slide member includes a plurality of pins which penetrate the slide member and are inserted in the annular groove of the switchover sleeve in a manner that allows rotation of the switchover sleeve relative to the slide member while permitting axial slide movement of the sleeve integrally with the slide member.

4. An electric power tool in accordance with claim 2, wherein the first diameter is greater than the second diameter.

5. An electric power tool in accordance with claim 1 further comprises:

a first internal gear disposed adjacent to and rear of the rear carrier;

a plurality of first planetary gears engaging and capable of revolving on an inner peripheral surface of the first internal gear; and a pinion mounted on the output shaft of the motor and engaging the first planetary gears, wherein the rear carrier is disposed between the first internal gear and the rear internal gear.

6. An electric power tool in accordance with claim 1 further comprising a third carrier disposed forward of the front carrier, wherein the spindle is coupled to the third carrier.

7. An electric power tool in accordance with claim 6 further comprising a clutch assembly provided around the spindle forward of the third carrier for disengaging and interrupting the transmission of the torque to the spindle when a load exerted on the spindle exceeds a user-set value.

8. An electric power tool in accordance with claim 1 further comprising a clutch assembly provided around the spindle forward of the front carrier for disengaging and interrupting the transmission of the torque to the spindle when a load exerted on the spindle exceeds a user-set value.

9. An electric power tool in accordance with claim 1 further comprising a slide member provided in the housing and capable of being slidably operated in axial directions, wherein the switchover means includes a switchover ring axially aligned with the two internal gears, one of the internal gears is interposed between the switchover ring and the other internal gear, and the switchover ring is rotatable and axially slidable between a first engagement position in which the switchover ring engages only the internal gear proximate to the switchover ring, and a second engagement position in which the switchover ring simultaneously engages the proximate internal gear and the carrier proximate to the ring, and the switchover ring is biased to the first engagement position under normal operating conditions, and further wherein the switchover means further includes an engagement element connected to the slide member so as to allow the engagement element and the slide member to move integrally in the axial directions, the engagement element being capable of selectively engaging the front and rear internal gears and the switchover ring, further wherein slide operation of the slide member causes the engagement element to move to a first slide position in which the engagement element engages the internal gear distal to the switchover ring and prohibits rotation of the distal internal gear relative to the housing, a second slide position in which the engagement element engages and prohibits rotation of the proximate internal gear relative to the housing, and a third slide position coincidental with the second engagement position, in which the engagement element engages the switchover ring.

10. An electric power tool in accordance with claim 9, wherein the switchover ring is located forward of the front and rear internal gears adjacent to the front internal gear, such that the front internal gear is the proximate internal gear and the rear internal gear is the distal internal gear, and further wherein when slid from the second slide position to the third slide position, the engagement element abuts and moves the switchover ring into engagement with the front carrier.

11. An electric power tool in accordance with claim 9, wherein the engagement element is configured to axially slide along and engage the first and second internal gears and the switchover ring so as to selectively prohibit rotation of the internal gears and the switchover ring.

12. An electric power tool in accordance with claim 9 further comprising a third carrier disposed forward of the front carrier, wherein the spindle is coupled to the third carrier.

13. An electric power tool in accordance with claim 12 further comprising a clutch assembly provided around the spindle forward of the third carrier for disengaging and interrupting the transmission of the torque to the spindle when a load exerted on the spindle exceeds a user-set value.

14. An electric power tool in accordance with claim 9 further comprising a clutch assembly provided around the spindle forward of the front carrier for disengaging and interrupting the transmission of the torque to the spindle when a load exerted on the spindle exceeds a user-set value.

15. An electric power tool in accordance with claim 9, wherein the first diameter is greater than the second diameter.

16. An electric power tool in accordance with claim 1, wherein the first diameter is greater than the second diameter.

* * * * *